US009027540B2

(12) United States Patent
Springer

(10) Patent No.: US 9,027,540 B2
(45) Date of Patent: May 12, 2015

(54) BOWSTRING RELEASE

(75) Inventor: Eric C. Springer, Moravia, NY (US)

(73) Assignee: Copper John Corporation, Auburn, NY (US)

( * ) Notice: Subject to any disclaimer, the term of this patent is extended or adjusted under 35 U.S.C. 154(b) by 541 days.

(21) Appl. No.: 13/361,336

(22) Filed: Jan. 30, 2012

(65) Prior Publication Data

US 2012/0192844 A1 Aug. 2, 2012

Related U.S. Application Data

(60) Provisional application No. 61/437,458, filed on Jan. 28, 2011.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/31, 35.2, 40, 86, 90
See application file for complete search history.

(56) References Cited

U.S. PATENT DOCUMENTS 3,853,111 A * 12/1974 Stanislawski et al. ..... 124/35.2
3,965,884 A * 6/1976 Killian ..... 124/35.2
4,282,851 A * 8/1981 Lyons ..... 124/35.2
4,392,475 A * 7/1983 Fletcher ..... 124/35.2
4,407,260 A * 10/1983 Lyons ..... 124/35.2
4,424,791 A * 1/1984 Muehleisen ..... 124/35.2
4,466,418 A * 8/1984 Jones ..... 124/35.2
4,498,448 A * 2/1985 Fletcher ..... 124/35.2
4,567,875 A * 2/1986 Fletcher ..... 124/35.2
4,625,705 A * 12/1986 Willits ..... 124/35.2
4,672,945 A * 6/1987 Carlton ..... 124/35.2
4,887,583 A * 12/1989 Lin ..... 124/40
4,930,485 A * 6/1990 Kopper ..... 124/91
4,949,698 A * 8/1990 Burnham ..... 124/35.2
4,981,128 A * 1/1991 Garvison ..... 124/35.2
5,025,772 A * 6/1991 Stevenson ..... 124/35.2
5,184,596 A * 2/1993 Green et al. ..... 124/35.2
5,224,463 A * 7/1993 Townsend ..... 124/35.2
5,247,922 A * 9/1993 Lalonde ..... 124/35.2
5,694,915 A * 12/1997 Summers ..... 124/35.2
6,478,020 B1 * 11/2002 Rentz ..... 124/35.2
6,571,786 B2 * 6/2003 Summers et al. ..... 124/35.2
6,584,966 B1 * 7/2003 Summers et al. ..... 124/35.2
6,606,984 B2 * 8/2003 Mugg ..... 124/35.2
6,631,709 B2 * 10/2003 Carter et al. ..... 124/35.2
6,647,976 B2 * 11/2003 Summers et al. ..... 124/35.2
6,736,124 B2 * 5/2004 Carter ..... 124/35.2
6,895,951 B2 * 5/2005 Summers et al. ..... 124/35.2
6,945,241 B2 * 9/2005 Pellerite ..... 124/35.2
6,953,035 B1 * 10/2005 Summers et al. ..... 124/35.2
6,957,644 B2 * 10/2005 Simo et al. ..... 124/35.2
7,325,539 B2 * 2/2008 Simo et al. ..... 124/35.2
7,574,999 B2 * 8/2009 Pardoski, Jr. ..... 124/35.2
7,581,536 B2 * 9/2009 Porter ..... 124/35.2
7,926,475 B2 * 4/2011 Jones ..... 124/35.2

(Continued)

*Primary Examiner* — Alvin Hunter
*Assistant Examiner* — Alexander Niconovich
(74) *Attorney, Agent, or Firm* — Hiscock & Barclay, LLP

(57) ABSTRACT

A bowstring release having a removable safety pin that when engaged, allows for training. The safety pin physically preventing the release mechanism from fully releasing, while allowing enough movement to provide a tactile response that the release has been activated.

20 Claims, 10 Drawing Sheets

(56) References Cited

U.S. PATENT DOCUMENTS

| | | | | |
|---|---|---|---|---|
| 2003/0037778 | A1* | 2/2003 | Carter et al. | 124/35.2 |
| 2003/0159682 | A1* | 8/2003 | Pellerite | 124/35.2 |
| 2004/0079351 | A1* | 4/2004 | Summers et al. | 124/35.2 |
| 2008/0149084 | A1* | 6/2008 | Whalen et al. | 124/35.2 |
| 2009/0056689 | A1* | 3/2009 | Jones | 124/35.2 |
| 2011/0168146 | A1* | 7/2011 | Deceuster | 124/35.2 |

* cited by examiner

BOWSTRING RELEASE

CROSS-REFERENCE TO RELATED APPLICATIONS

This application claims the benefit of provisional application No. 61/437,458, filed Jan. 28, 2011.

FIELD OF THE INVENTION

This invention relates to archery accessories, and more particularly, to a bowstring release having a removable safety pin.

BACKGROUND OF THE INVENTION

Release aids are used to hold a bowstring in the drawn position. The release attaches to the bowstring and pulls the bowstring to the drawn position. The user then activates the release, either by activating a trigger or by twisting the release, to separate the bowstring from the release thereby allowing the bowstring to fire an arrow. The release allows the user to utilize a device with an ergonomic and more secure grip. Additionally, the release provides protection to the users hands from repeated draws and release of the bowstring.

There are two main types of releases, trigger activated releases and back tension releases. Trigger activated release contain a trigger mechanism, which when activated, releases the hook holding the bowstring. Back tension releases do not use a trigger. Instead, when in the drawn position the user gives a slight twist of the release. This activates the release and the hook releases the bowstring. Becoming proficient with back tension releases requires practice to prevent accidental activation of the release resulting in misfired shots, or unexpected release. When applying force during the draw of a bowstring, an expected release could result in the user hitting themselves in the face with great force, potentially causing serious injuries.

For trigger activated releases, there exist safety mechanisms that prevent the trigger from activating the release. However, these types of safety mechanisms are ineffective for back tension releases.

Therefore, a release having a removable safety pin is desired.

Further, a release having a safety pin that allows for feedback as to the exact release point without releasing the bowstring is desired.

SUMMARY OF THE INVENTION

The invention comprises, in one form thereof, a release having a body, a release mechanism attached to the body via a hinge and a safety pin. When the safety pin is engaged, the release mechanism's range of motion is restricted. Thereby, preventing the release from activating and releasing a bowstring.

More particularly, the invention includes a grip for holding the release. A user hooks a bowstring into the bowstring hook and pulls on the release to draw the bow. With the safety pin removed, or stored in the optional storage, the user activates the release. The release mechanism pivots along the hinge allowing the bowstring hook to release to bowstring.

In another form, with the safety pin affixed to the safety lock on the release mechanism, a user draws a bowstring as described above. However, upon activation of the release, the release mechanism is physically blocked by the safety pin. Thereby, preventing the bowstring hook from releasing the bowstring.

In yet another form, the release has a sear. The bowstring hook rests against the sear. Upon activation of the release, the bowstring hook slides off of the sear allowing for the release mechanism to pivot around the hinge pin. With the safety pin engaged, this merely provides a tactile response to the release being activated without allowing the bowstring hook to release the bowstring.

An advantage of the present invention is that the safety pin prevents the release mechanism for releasing the bowstring.

A further advantage of the present invention is that the safety pin allows for shooters to train with the release without fear of accidental release of the bowstring.

An even further advantage of the present invention is that with the safety pin engaged, the release provides a tactile response that the release has been activated.

Another advantage of the present invention is that the release contains a storage compartment for the safety pin when not in use.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
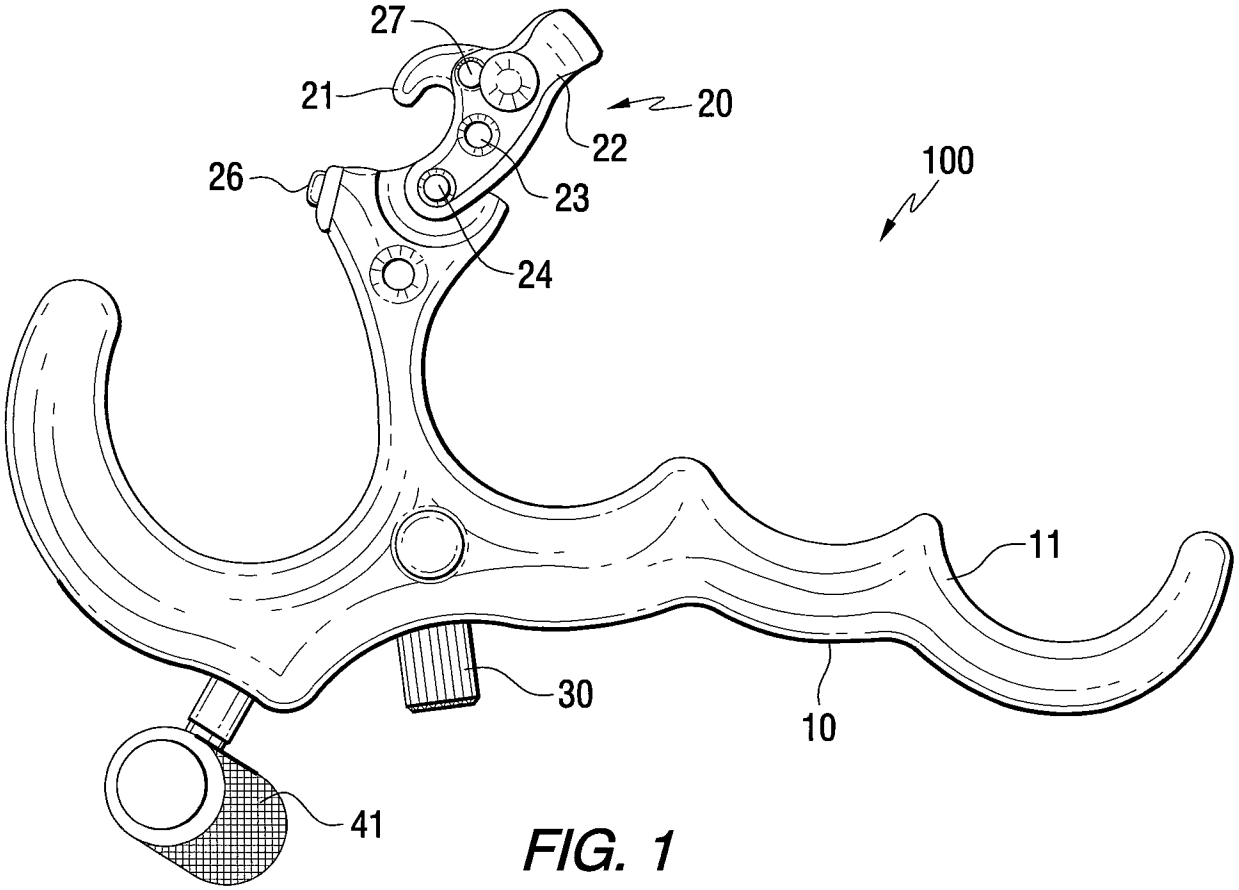
FIG. 1 depicts a release according to one embodiment.

Referring to FIG. 1, there is shown the bowstring release according to one embodiment of the present invention. The release 100 includes a body 10, a release mechanism 20 and a safety pin 30. Optionally, the release 100 includes a pulling post assembly 40. In one embodiment, the body 10 further contains a safety pin storage 12. In embodiments in which the safety pin 30 is a threaded safety pin, the safety pin storage may have a threaded portion to receive and secure the safety pin 30 in place.

Figures 2A, 2B:
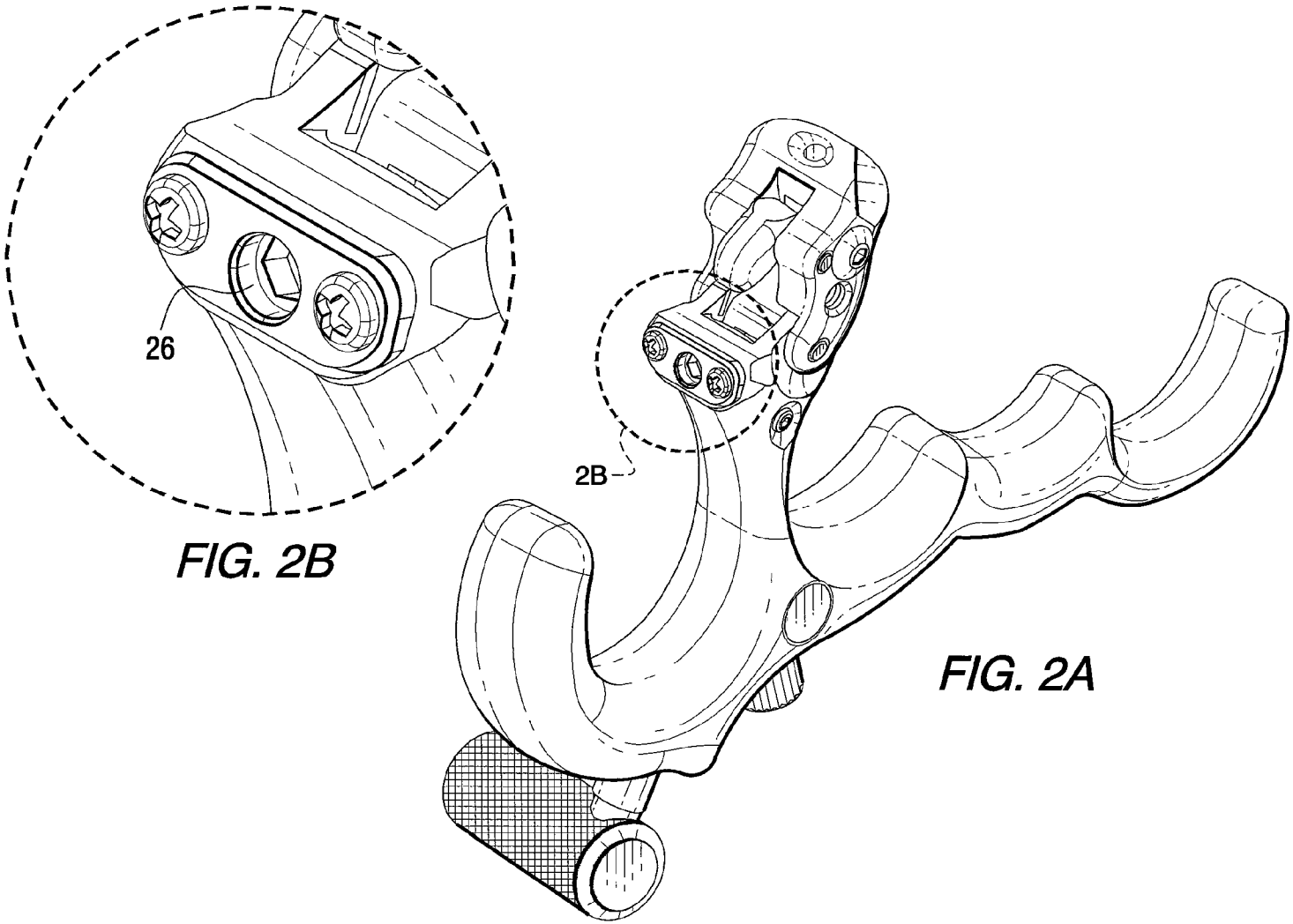
FIG. 2A depicts an isometric view of the release shown in FIG. 1.
FIG. 2B is an enlarged view of the sear adjustment shown in FIG. 2A.

Referring now to FIGS. 2A-2B, a release mechanism 20 is affixed to the body 10 via hinge pin 24. The hinge pin 24 allows the hinged release 22 to pivot along the axis defined by the hinge pin 24. A bowstring hook 21 is attached to the hinged release 22 via a bowstring hinge pin 27 allowing the bowstring hook 21 to pivot along the axis defined by the bowstring hinge pin 27. A safety lock hole 23 allows for attachment of the safety pin 30 (shown in FIGS. 6-9). In one embodiment a sear 25 is attached to the body 10. In use, the bowstring hook 21 rests against the sear 25 as a bowstring is pulled into the drawn position. When the release 100 is activated the bowstring hook 21 slides off of the sear 25 allowing the hinged release 22 and the bowstring hook 21 to pivot and release a bowstring (not shown). It is understood that the bowstring hook may be an open hook or a closed hook depending on the particular embodiment.

FIG. 2B depicts an enlarged view of the sear adjustment 26. By adjusting the positioning of the sear 25, the user can fine tune the release point of the bowstring hook 21.

Figure 3A:
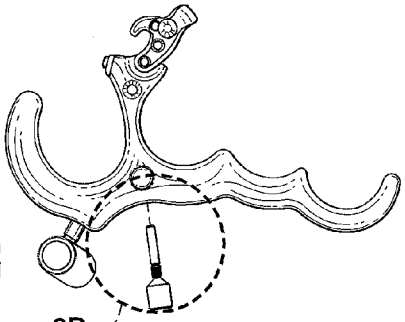
FIGS. 3A-3F depict various options for storing and engaging the safety pin.
Figure 3D:
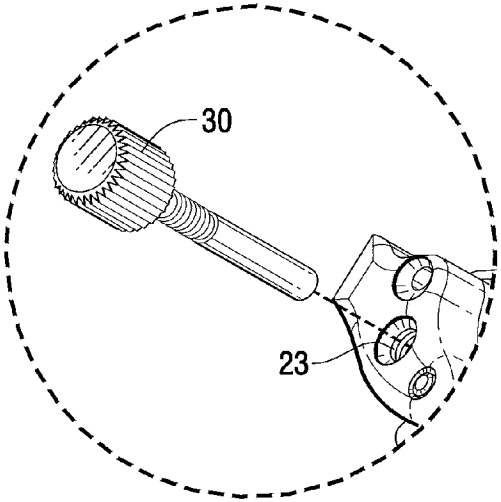
Figure 3C:
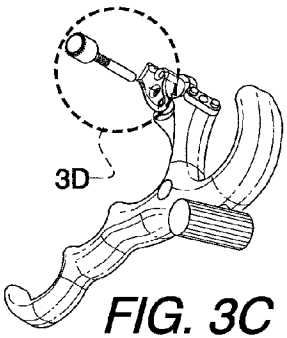
Figure 3B:
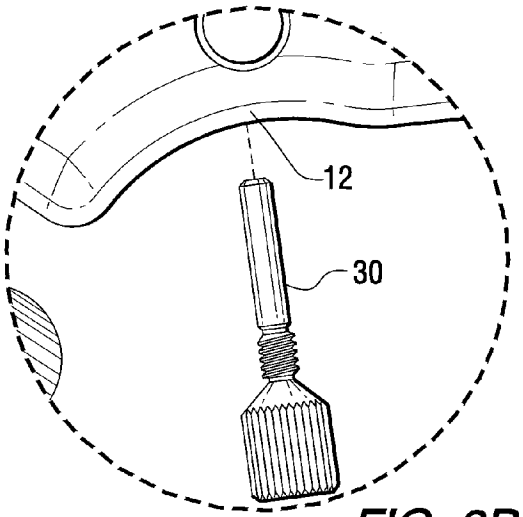
Figure 3F:
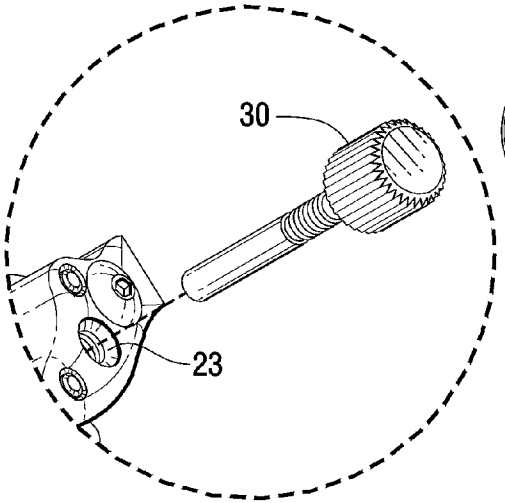
Figure 3E:
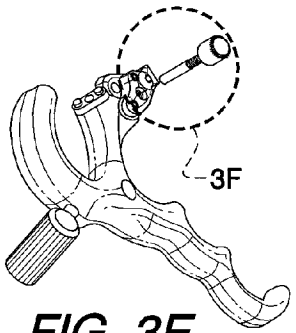

Referring now to FIGS. 3A-3F, there is shown the safety pin 30 used for various purposes. In the embodiments shown the safety pin is a threaded safety pin. FIG. 3B is an enlarged view of the section circled in FIG. 3A. The safety pin 30 is placed in the safety pin storage 12 on the body 10 when not in use. FIGS. 3D and 3F are enlarged views of the circled areas of FIGS. 3C and 3E respectively. The safety pin 30 may be placed into either side of the safety lock 23. This is advantageous as the device can be used for both left-handed and right-handed shooters. While the safety pin is shown as a cylindrical pin, it is understood that the safety pin may be of any shape so long as it physically blocks the bowstring hook 21.

Figure 4:
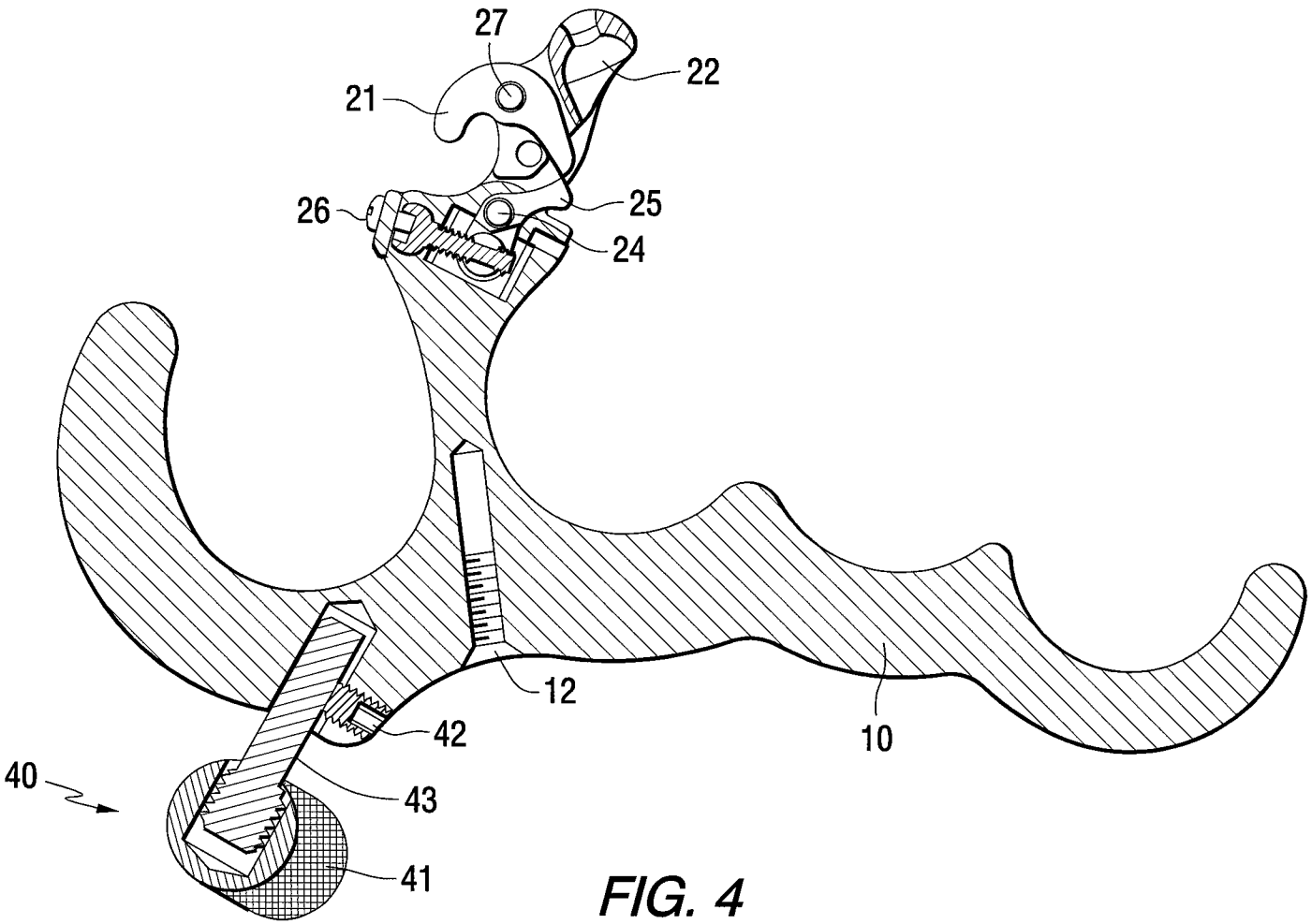
FIG. 4 is a schematic view of the release shown in FIG. 1 in the drawn position.

Referring now to FIG. 4, there is shown a schematic view of release 100 in the drawn position. In one embodiment, the release includes a pulling post assembly 40. Optionally, the pulling post assembly 40 is an adjustable pulling post assembly having a pulling post 41 attached to a threaded post 43. The threaded post 43 being held into position on the body 10 by a set screw 42. This allows the pulling post 41 to be angled and moved to the users preference. In another embodiment, the pulling post assembly 40 is a trigger mechanism used to activate the release.

Figure 5:
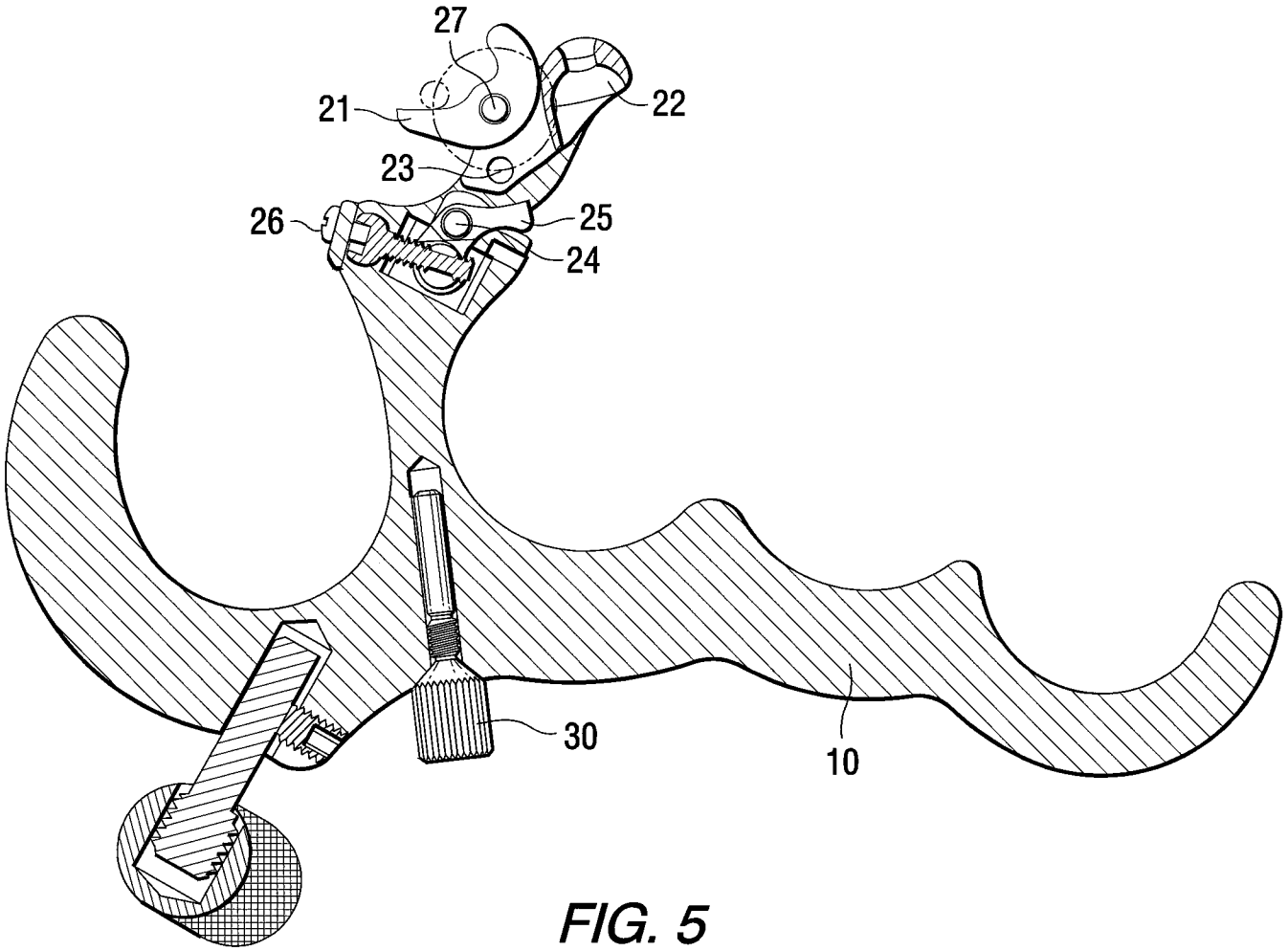
FIG. 5 is a schematic view of the release shown in FIG. 1 in the release position.

Still referring to FIG. 4, there is shown the release mechanism 20. The bowstring hook 21 rests along the sear 25. When under tension, the bowstring hook 21 remains pressed against the sear 25 until the release is activated. As shown in FIG. 5, the release 100 has been activated. The bowstring hook 21 has moved off of the sear 25 and the tension from the bowstring allows the bowstring hook 21 and the hinged release 22 to move into the released position, thereby releasing the bowstring.

With the safety pin 30 in the safety lock 23 the release mechanism 20 cannot fully activate. When the bowstring is drawn the release 100 is in the position shown in FIG. 4 with the bowstring hook 21 resting on the sear 25. When activated, the bowstring hook 21 slips off the sear 25 only instead of fully releasing, the bowstring hook 21 physically comes in contact with safety pin 30. This prevents the bowstring hook 21 from fully pivoting and releasing the bowstring. However, because the bowstring hook 21 does slip off the sear 25, the user is giving a tactile feel that the release has been activated. In one embodiment, this slipping also produces an audible sound.

Figure 6:
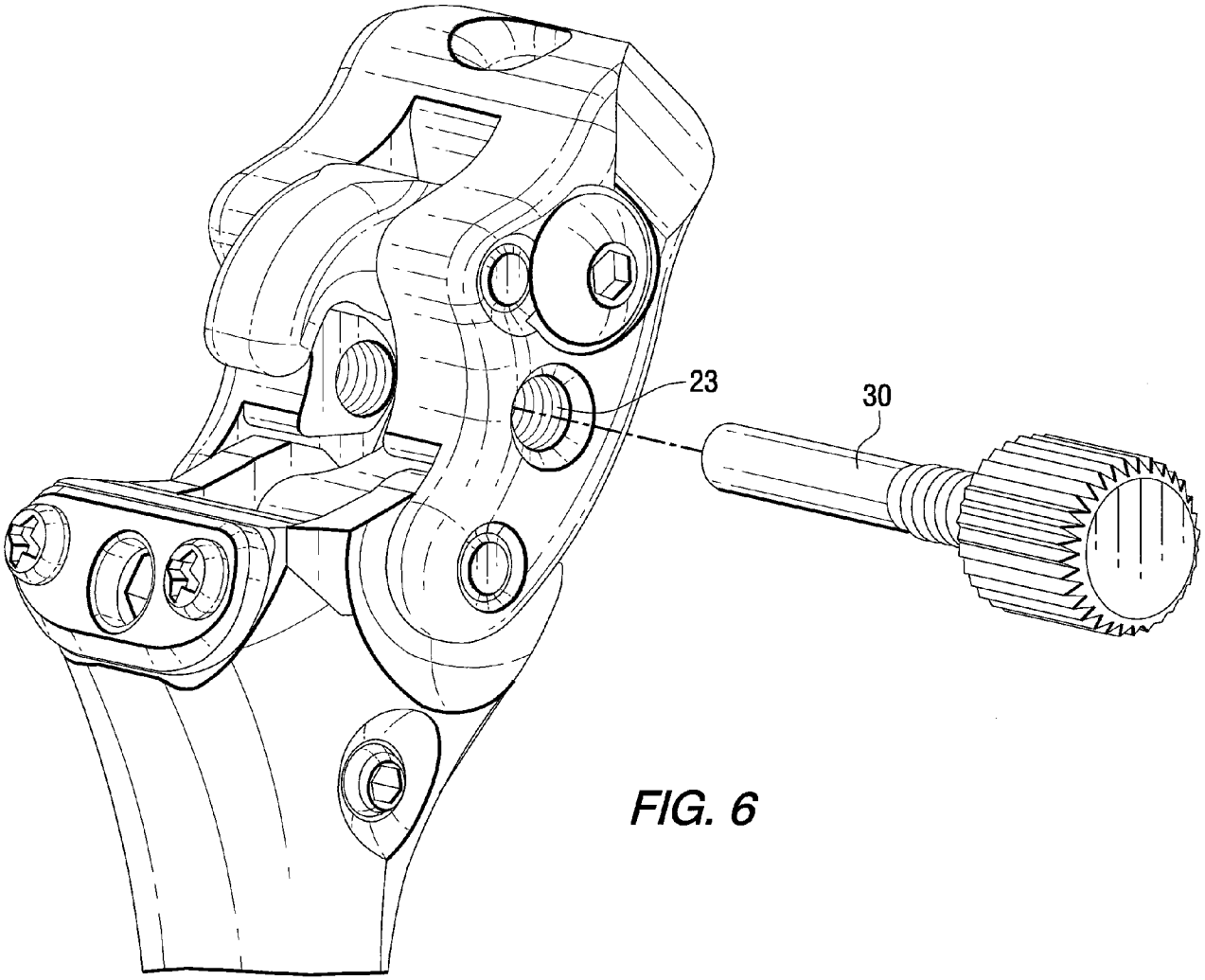
FIG. 6 depicts an enlarged view of the release mechanism with the safety pin removed.
Figure 7:
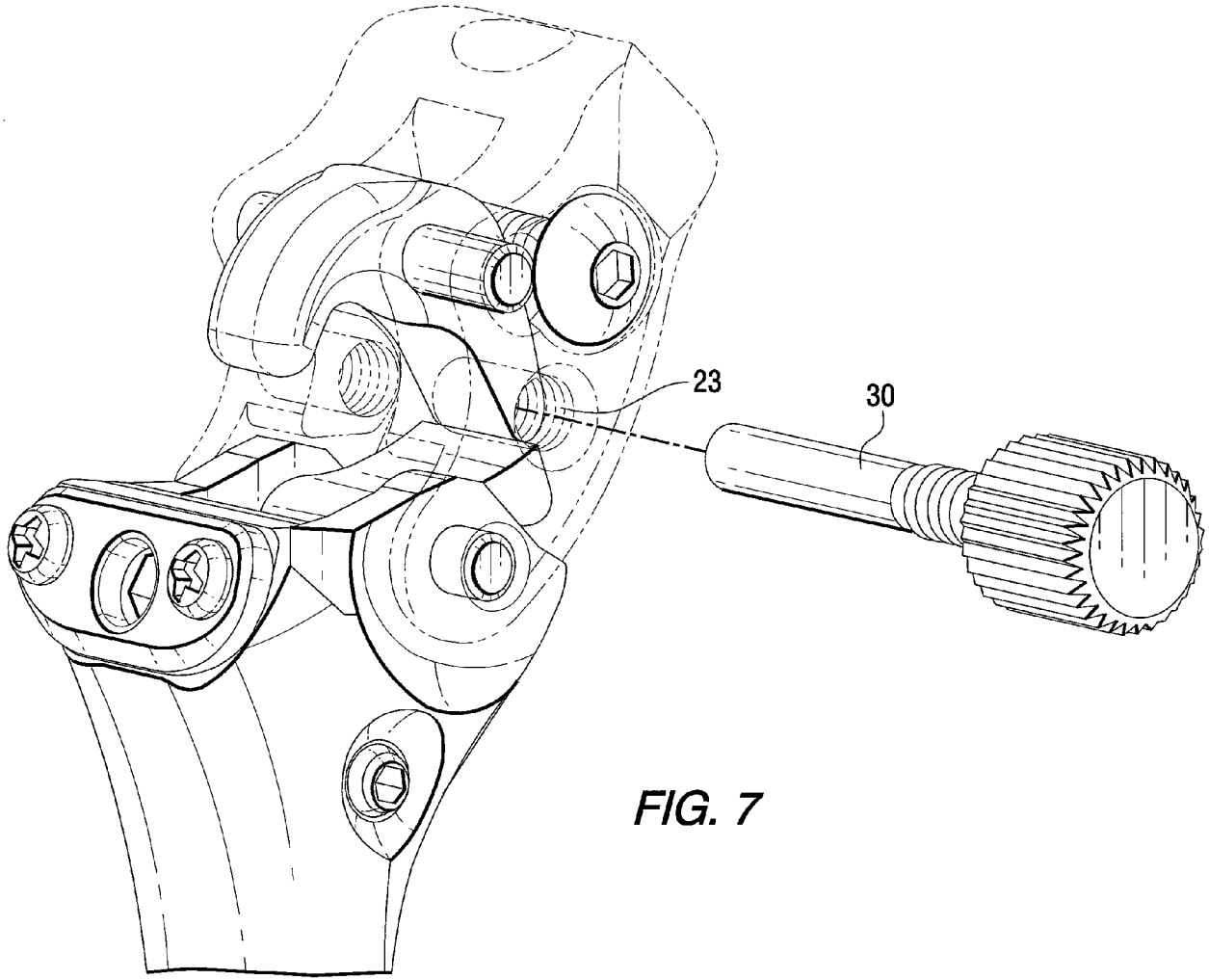
FIG. 7 is a transparent enlarged view of the release mechanism with the safety pin removed as shown in FIG. 6.
Figure 8:
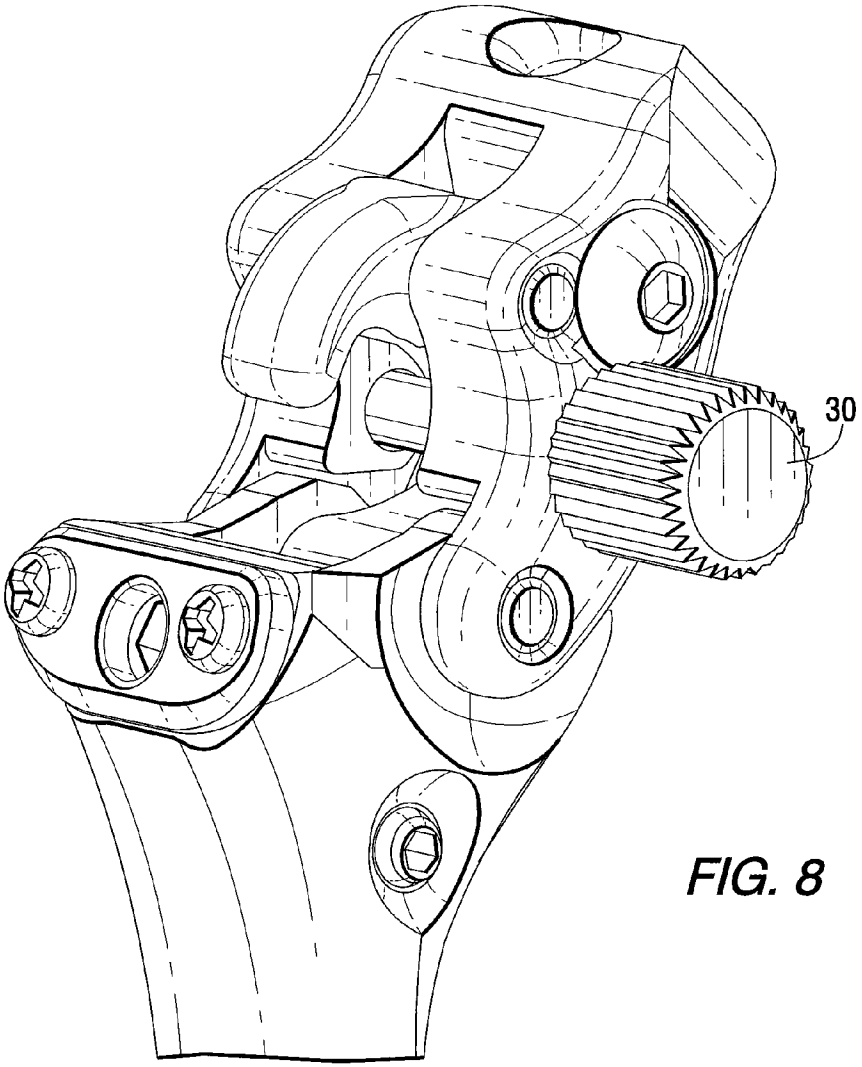
FIG. 8 depicts an enlarged view of the release mechanism with the safety pin engaged.
Figure 9:
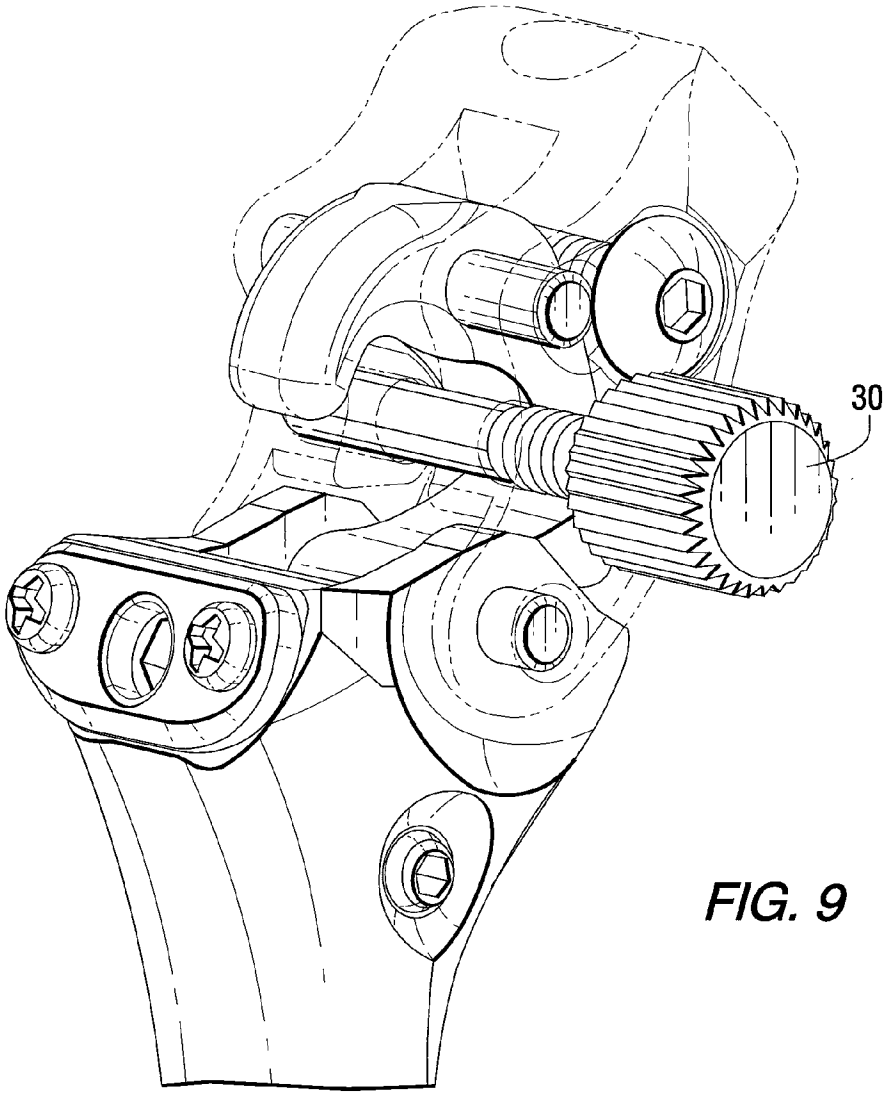
FIG. 9 is a transparent enlarged view of the release mechanism with the safety pin engaged as shown in FIG. 8.
Figure 10A:
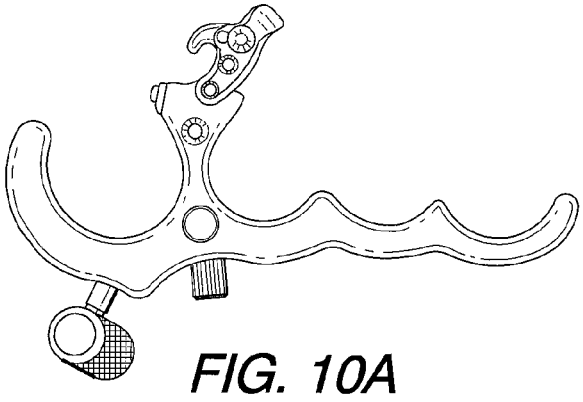
FIGS. 10A-10E depict releases according to various additional embodiments.
Figure 10B:
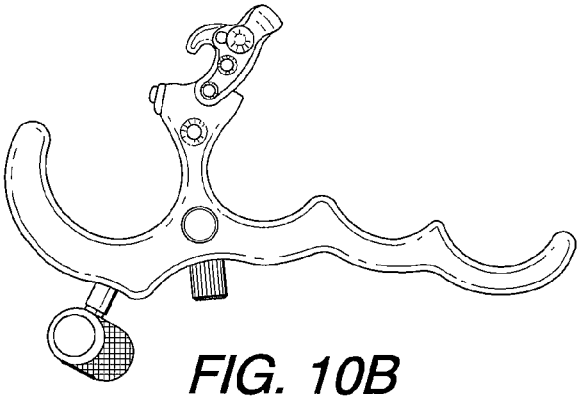
Figure 10C:
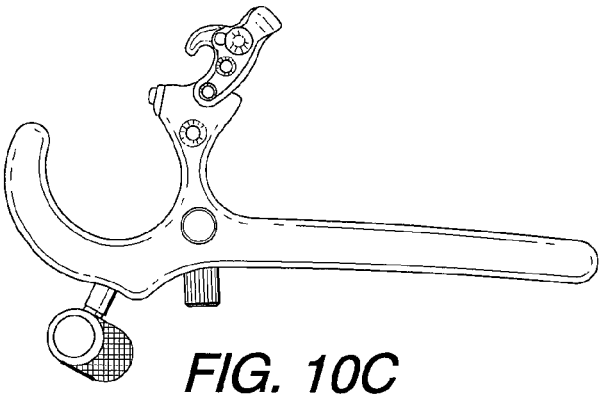
Figure 10D:
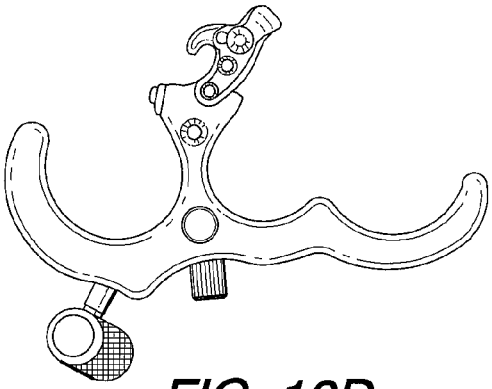
Figure 10E:
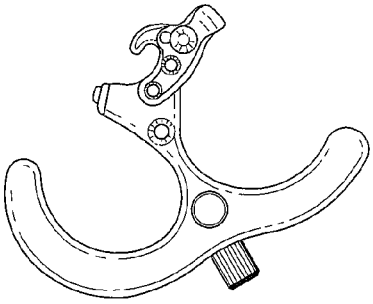

Referring to FIGS. 6 and 7 there is shown an enlarged view of the release mechanism with the safety pin 30 removed. To engage the safety pin 30, it is threaded into the safety lock hole 23 to lock the device as shown in FIGS. 8 and 9. The safety pin 30 physically prevents the bowstring hook from fully releasing a bowstring when engaged.

Referring now to FIGS. 10A-10E, there are shown various releases. It is understood that the examples are merely demonstrative and are not intended to be limiting. For example, closed loop grips and the such may be substituted for the open design. In addition, the pulling post may be replaced with a trigger mechanism changing the release from a back tension release to a trigger type release. Also a trigger mechanism as known to those skilled in the art my be added at locations other than the pulling post.

In use, a shooter uses the release 100 to draw a bowstring. The bowstring hook 21 secures the bowstring and the shooter pulls back on the body 10. The bowstring hook 21 rests against the sear 25. When the release 100 is activated, the bowstring hook 21 slides off the sear 25 allowing the release mechanism to release the bowstring. However, if the safety pin 30 is placed in the safety lock 23, the bowstring hook 21 physically contacts the safety pin 30. This prevents the bowstring hook 21 from full range of motion and retains the bowstring in the bowstring hook. The slight movement of the bowstring hook 21 provides the user with a tactile signal that the release had been activated allowing for better training and fine tuning.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

PARTS LIST

10 Body
11 Grip
12 Safety pin storage
20 Release mechanism
21 Bowstring hook
22 Hinged release
23 Safety lock hole
24 Hinge pin
25 Sear
26 Sear adjustment
27 Bowstring hook hinge
30 Safety pin
40 Pulling post assembly
41 Pulling post
42 Set screw
43 Threaded post
100 Release

The invention claimed is:

1. A bowstring release comprising:

a body comprising a sear;

a release mechanism comprising a bowstring hook and a bowstring hinge pin that allows the bowstring hook to pivot along an axis defined by the bowstring hinge pin; and a safety pin, the safety pin, when engaged, physically prevents the bowstring hook from full movement when the bowstring hook slides off the sear, thereby preventing the release mechanism from releasing a bowstring.

2. The bowstring release of claim 1, where the release mechanism produces a tactile response when activated.

3. The bowstring release of claim 1, where the release mechanism produces an audible response when activated.

4. The bowstring release of claim 1, where the release mechanism is affixed to the body via a hinge pin that allows a hinged release to pivot along an axis defined by the hinge pin.

5. The bowstring release of claim 1, where the release mechanism further comprises a safety lock hole for attachment of a safety pin, when attached, the safety pin prevents full release of the bowstring hook.

6. The bowstring release of claim 5, further comprising a sear adjustment to move the sear and allow for fine tuning of the release point of the bowstring hook.

7. The bowstring release of claim 6, where the bowstring release is a back tension release and the release mechanism is activated by twisting the body, thereby allowing the bowstring hook to slide off the sear.

8. The bowstring release of claim 1, where the body further comprises a safety pin storage for storage of the safety pin when not in use.

9. The bowstring release of claim 1, where the body further comprises a pulling post assembly comprising a pulling post affixed to a threaded post and a set screw to secure the threaded post to the body.

10. The bowstring release of claim 1, wherein the safety pin is a cylindrical threaded safety pin.

11. The bowstring release of claim 1, wherein the release mechanism is a back tension release mechanism.

12. The bowstring release of claim 1, wherein the safety pin is disposed between the sear and the bowstring hook.

13. The bowstring release of claim 1, wherein the safety pin is disposed between the sear and the bowstring hook and the bowstring hook directly contacts the safety pin after the bowstring hook slides off the sear.

14. A bowstring release comprising:

a body comprising a sear;

a trigger activated release mechanism comprising a trigger and a bowstring hook and a bowstring hinge pin that allows the bowstring hook to pivot along an axis defined by the bowstring hinge pin; and a safety pin, the safety pin, when engaged, physically prevents the bowstring hook from full movement after the bowstring hook slides off the sear, thereby preventing the trigger activated release mechanism from releasing a bowstring while giving a tactile response that the bowstring release has been activated.

15. The bowstring release of claim 14, wherein activating the trigger activated release mechanism with the safety pin engaged produces a tactile response without releasing the bowstring.

16. The bowstring release of claim 15, wherein the safety pin physically engages the bowstring hook to prevent release of the bowstring.

17. A bowstring release comprising:

a body comprising a sear;

a release mechanism comprising a bowstring hook and a bowstring hinge pin allowing the bowstring hook to pivot along an axis defined by the bowstring hinge pin; and a safety pin, the safety pin, when engaged, physically prevents the bowstring hook from full movement of the bowstring hook when the bowstring hook slides off the sear by directly contacting the bowstring hook with the safety pin, thereby preventing the release mechanism from releasing a bowstring while giving a tactile response that the bowstring release has been activated.

18. The bowstring release of claim 17, wherein the release mechanism produces an audible response when activated.

19. The bowstring release of claim 17, wherein the safety pin is disposed between the sear and the bowstring hook.

20. The bowstring release of claim 17, where the bowstring release is a back tension release and the release mechanism is activated by twisting the body, thereby allowing the bowstring hook to slide off the sear.

* * * * *